United States Patent [19]

Fredriksson

[11] Patent Number: 4,722,108

[45] Date of Patent: Feb. 2, 1988

[54] BRIDGE ARRANGEMENT

[75] Inventor: Ingemar Fredriksson, Stallarholmen, Sweden

[73] Assignee: Fredriksson & Ribring AB, Stallarholmen, Sweden

[21] Appl. No.: 19,577

[22] Filed: Feb. 27, 1987

[30] Foreign Application Priority Data

Feb. 27, 1986 [SE] Sweden ..... 8600871

[51] Int. Cl.[4] ..... E01D 15/14

[52] U.S. Cl. ..... 14/27; 14/1; 89/36.01; 135/90; 428/919

[58] Field of Search ..... 14/1, 2.4, 27, 28, 73, 14/74; 89/36.01, 36.04; 428/919; 135/90, 115; 441/35, 44; 404/18, 35

[56] References Cited

U.S. PATENT DOCUMENTS

| | | | |
|---|---|---|---|
| 2,692,101 | 10/1954 | Doolittle et al. | 14/28 X |
| 3,458,884 | 8/1969 | Gurganious | 14/27 |
| 3,607,592 | 9/1971 | Jenkins | 14/1 X |

FOREIGN PATENT DOCUMENTS

| | | | |
|---|---|---|---|
| 886879 | 11/1971 | Canada | 14/27 |
| 2409745 | 9/1975 | Fed. Rep. of Germany | 89/36.01 |
| 2471445 | 6/1981 | France | 14/1 |
| 737549 | 6/1980 | U.S.S.R. | 14/27 |

*Primary Examiner*—Stephen J. Novosad
*Assistant Examiner*—John F. Letchford
*Attorney, Agent, or Firm*—Dennison, Meserole, Pollack & Scheiner

[57] ABSTRACT

A temporary or permanent bridge is constructed to enable transportation across a waterway. In wartime such a bridge constitutes a bombing target. The object of the present invention is to draw attention to said bridge by creating one or more false bridges one beside the other, each consisting of a frame provided with floating elements (11,16,19 and 22) and a covering layer (23) which, seen from above, give the impression of a roadway.

3 Claims, 3 Drawing Figures

BRIDGE ARRANGEMENT

The present invention relates to a bridge arrangement. A bridge arrangement may be a bridge constructed between two shores and intended to be permanent if it is cast in concrete or consists of an iron construction. However, it is also possible to obtain a bridge arrangement between two shores which is intended to be used temporarily and then dismantled. Bridges of this type are extremely vulnerable in wartime and are easy targets for bombing attacks from enemy aircraft. The problem is, therefore, to protect such bridges from destruction.

The object of the present invention is to eliminate said problem and this is achieved by arranging one or more units on one or both sides of a bridge which is being used, the units appearing from the air to be a bridge. Such a bridge consists of a frane provided uppermost with a covering layer giving the impression of a roadway, and provided with floating elements.

Said frame may consist of a number of transverse elements arranged one after the other in the longitudinal direction of the bridge, these transverse elements being joined together by means of one or more connecting elements. The transverse elements are provided with an edge surface such that when a covering layer is placed over the transverse elements, it gives the impression of a roadway when viewed from above.

The covering layer may consist of netting, canvas, foil of suitable material such as plastic, and may be painted in such a manner that the surface of the covering layer has the appearance of the surface of a roadway.

The covering layer may be rolled up like a carpet and have a length corresponding to the length of the bridge. The layer is rolled out just like a carpet.

The frame can be assembled in sections on land and be gradually pushed out into the water in a waterway. A covering layer may be rolled out on each finished unit, from a roll being the same width as the frame.

It would undoubtedly be advantageous to camouflage the roads to a usable bridge and instead mark out roads to the bridges with covering layers. This bridges might be called false or dummy bridges.

Additional features of the present invention are revealed in the following claims.

Figure 1:
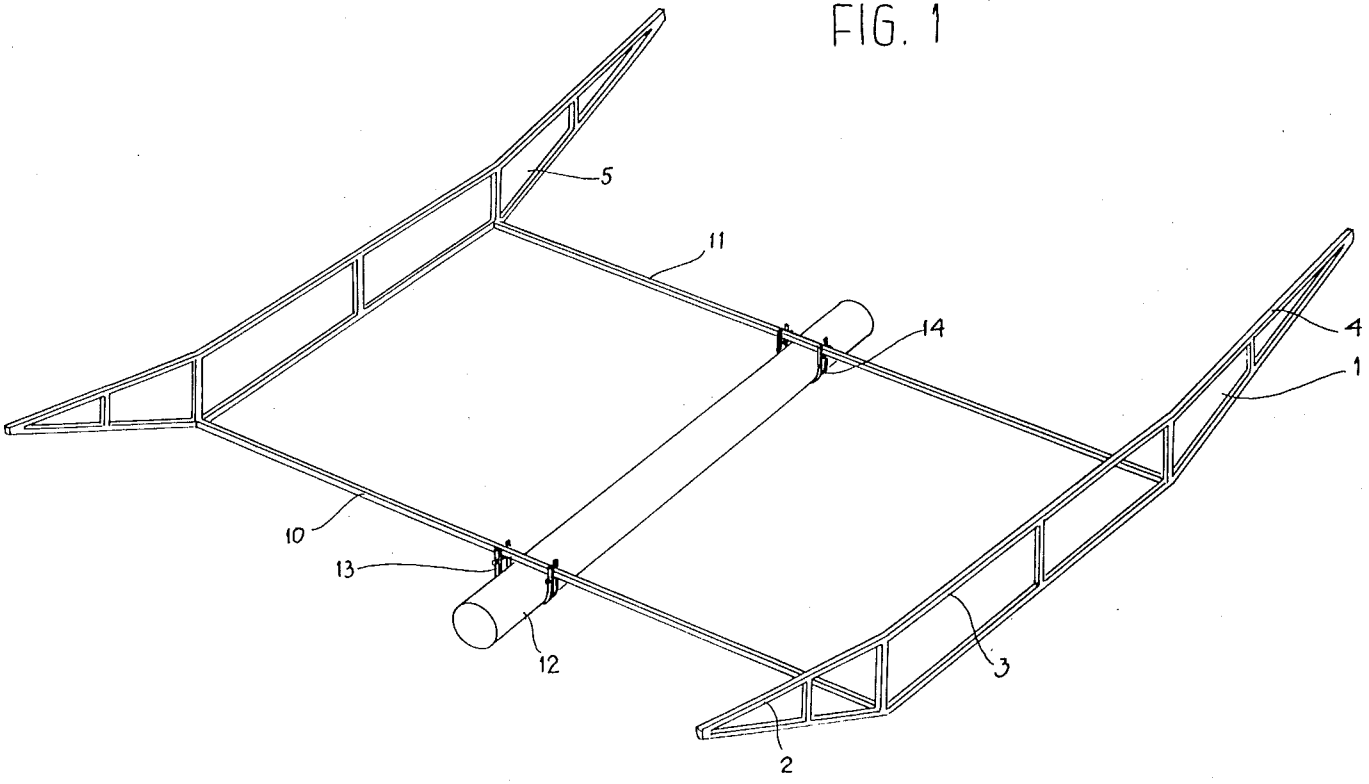
Figure 2:
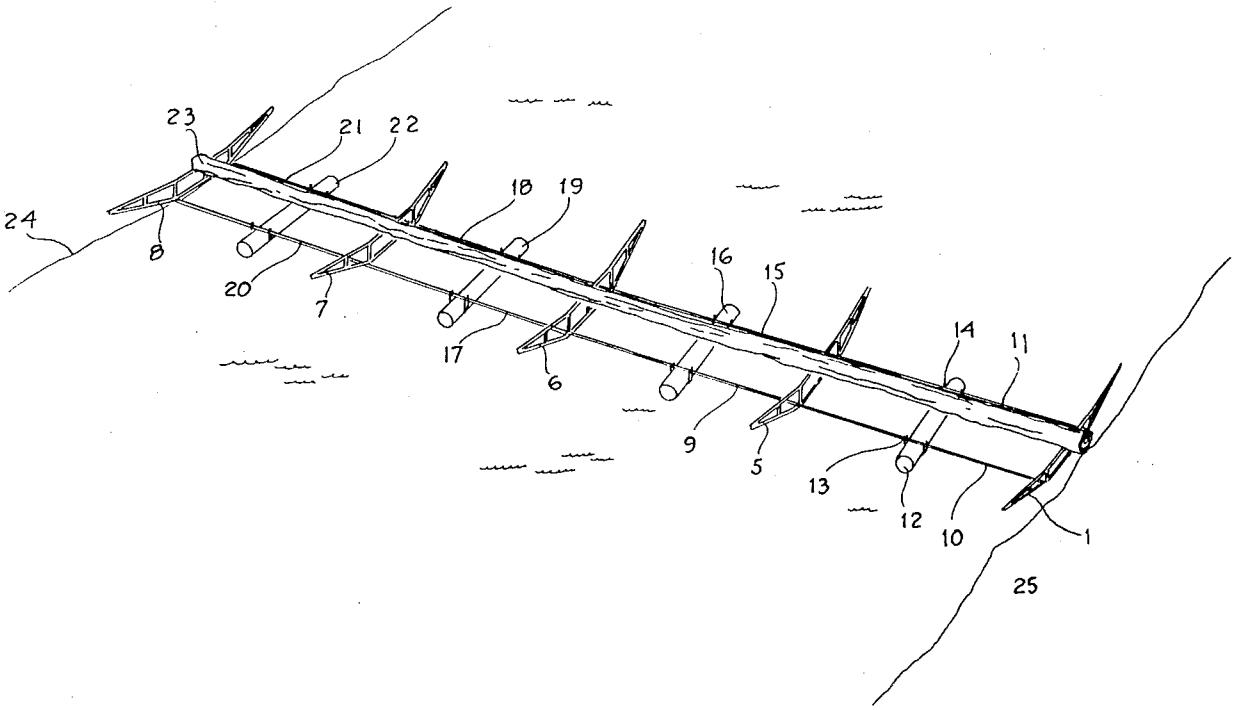
Figure 3:
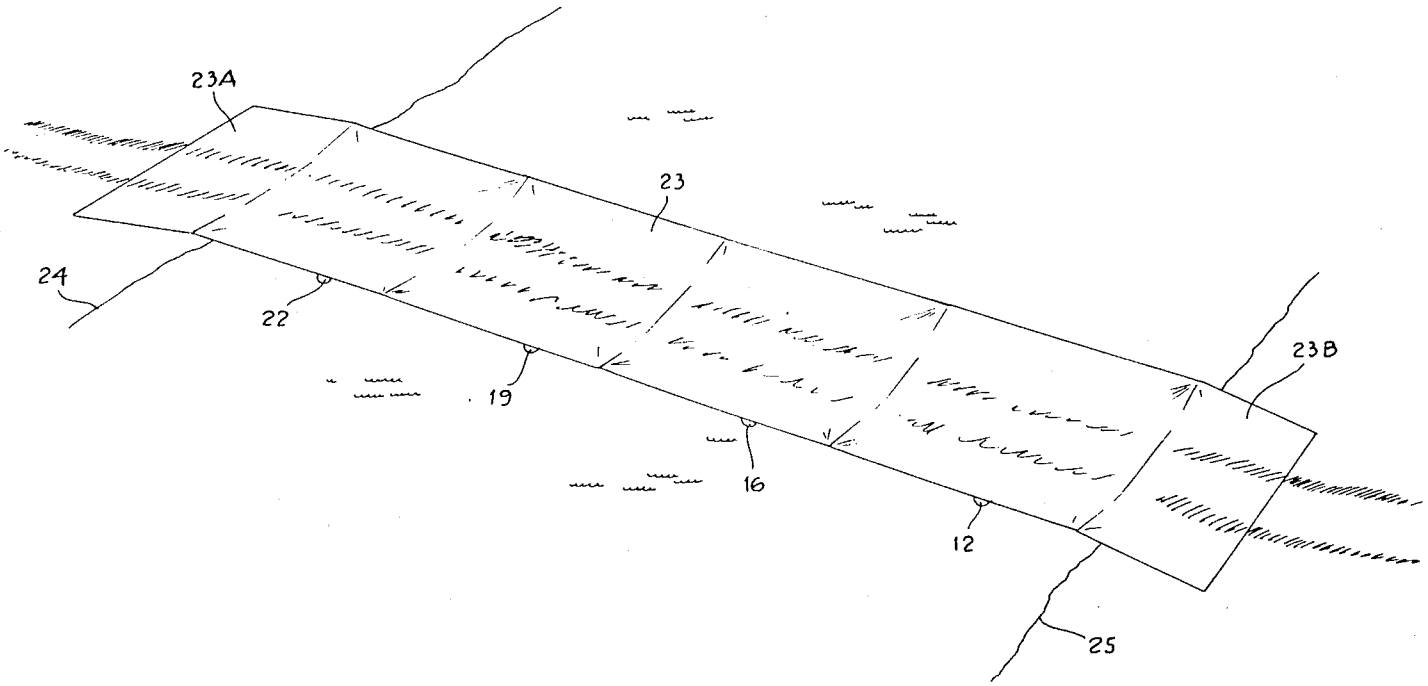

The present invention will be described in more detail with reference to the accompanying three sheets of drawings, in which FIG. 1 shows a section of a bridge arrangement according to the present invention consisting of two transverse elements and connecting elements between the two transverse elements, FIG. 2 shows a bridge arrangement in its entire length, before application of the covering layer, and FIG. 3 shows a bridge arrangement with the covering layer in place.

FIG. 1 shows two transverse elements 1 and 5, each being formed as a framework with an upper edge surface 2,3 and 4. The edge surface corresponds to the upper edge surface of the cross section of a roadway. The two transverse elements 1 and 5 are joined together with the aid of two connecting elements 10 and 11. Between the two transverse elements 1 and 5 is a floating body 12, which is secured to the connecting elements 10 and 11 by attachment elements 13 and 14. The section shown can then be added to as shown in FIG. 2.

Here, three more transverse elements 6 to 8 have been added and are kept aligned by the connecting elements 9 and 15, 17 and 18, and 20 and 21. The three additional sections are provided with floating elements 16, 19 and 22. FIG. 2 shows a complete bridge skeleton and a roll of covering layer 23, rolled up exactly like a carpet, is placed on the transverse elements. This covering layer is then rolled out onto the transverse elements in the manner shown in FIG. 3. The covering layer 23 may be provided at the ends with extensions 23A and 23B so as to better fit into the surroudings on the ground on each shore 24,25 of the waterway.

Each section can be constructed on land and gradually pushed out into the waterway as one section is joined to another. The covering layer 23 can be pulled out from a roll having the same width as the framework. Enough covering material 23 is thus unrolled to cover each section as it is finished.

A floating body may also be applied to a transverse element. The outermost ends of the transverse elements may be joined together by connecting elements.

A cable or wire may be arranged on both sides or one side of the bridge, anchored to the land and serving to secure the bridge.

The central part of the covering layer may be meshlike and the edge parts may be more clothlike.

The bridge described above may be termed a false bridge or dummy bridge. It is intended to be viewed from above and need not therefore be made very high, so that a bridge laid in this manner will remain in position. The bridge may be provided with anchors and the like to additionally secure its position. In order to promote the deception, one or more bridges may be constructed on one or both sides of the bridge actually usable for transportation. In this case the roads leading to the usable bridge should be camouflaged and the roads to the bridge(s) according to the present invention should be clearly marked by clearing vegetation, for instance.

The number of transverse elements 1 and 5–8 may be limited, producing a unit which is shorter than the width of the waterway. The shorter unit may be used as a camouflage ferry. If all the parts in the unit were to be dimensioned to carry a heavy object, the camouflage ferry would also have some practical use.

I claim:

1. A simulated bridge having the appearance of a real bridge and including a support structure and a simulated deck structure, said support structure including at least a pair of support elements disposed one adjacent each end of said bridge and generally transverse to the longitudinal centerline thereof and at least one connecting element extending between said support elements, float means carried by said connecting elements to bouyantly support said bridge and simulated deck means extending across said support means to simulate a roadway across said bridge, said simulated deck means consisting of a roll of covering fabric positioned over said support structure and having the appearance of an actual bridge deck.

2. A simulated bridge defined according to claim 1, wherein the simulated deck (23,23A and 23B) consists of cloth fabric.

3. A simulated bridge according to claim 2, characterised in that the covering layer is painted to give the appearance of a roadway on a bridge.

* * * * *